United States Patent [19]

Marth et al.

[11] Patent Number: 4,704,592

[45] Date of Patent: Nov. 3, 1987

[54] CHIP INDUCTOR ELECTRONIC COMPONENT

[75] Inventors: Kurt Marth, Regensburg; Gerhard Müller, Adlersberg; Jürgen Pütz; Josef Schindler, both of Regensburg, all of Fed. Rep. of Germany

[73] Assignee: Siemens Aktiengesellschaft, Berlin and Munich, Fed. Rep. of Germany

[21] Appl. No.: 761,288

[22] Filed: Aug. 1, 1985

[30] Foreign Application Priority Data

Sep. 13, 1984 [DE] Fed. Rep. of Germany ..... 3433692

[51] Int. Cl.[4] ..... H01F 15/02; H01F 15/10

[52] U.S. Cl. ..... 336/83; 336/84 M; 336/192; 336/208

[58] Field of Search ..... 336/90, 92, 192, 208, 336/209, 198, 83, 65, 84 R, 84 M; 310/71; 338/302, 303, 296

[56] References Cited

U.S. PATENT DOCUMENTS

| | | | |
|---|---|---|---|
| 1,997,198 | 4/1935 | Ogg | 338/302 X |
| 2,339,067 | 1/1944 | Franz | 336/192 |
| 3,117,294 | 1/1964 | Muszynski et al. | 336/208 X |
| 3,533,054 | 10/1970 | Spriggs et al. | 339/221 |
| 3,585,450 | 6/1971 | Lane | 336/192 X |
| 3,585,553 | 6/1971 | Muckelroy et al. | 336/192 |
| 3,663,914 | 5/1972 | Lane | 336/192 |
| 3,735,214 | 5/1973 | Renskers et al. | 317/234 R |
| 3,800,172 | 3/1974 | Antin et al. | 336/192 X |
| 4,166,265 | 8/1979 | Reynolds et al. | 336/192 |
| 4,314,221 | 2/1982 | Satou et al. | 336/192 |
| 4,361,773 | 11/1982 | Mokrzycki | 310/71 |

FOREIGN PATENT DOCUMENTS

| | | | |
|---|---|---|---|
| 239912 | 11/1960 | Australia | 336/192 |
| 2148534 | 4/1973 | Fed. Rep. of Germany | 336/192 |
| 2236241 | 2/1974 | Fed. Rep. of Germany | 336/192 |
| 2454175 | 5/1976 | Fed. Rep. of Germany . | |
| 3225782 | 2/1982 | Fed. Rep. of Germany . | |
| 164307 | 8/1985 | Japan | 336/192 |
| 2102632 | 2/1983 | United Kingdom . | |
| 397536 | 8/1983 | United Kingdom | 336/192 |

*Primary Examiner*—Thomas J. Kozma
*Attorney, Agent, or Firm*—John Francis Moran

[57] ABSTRACT

An electronic component such as a chip inductor, in particular an air core coil, RF choke and transformer is disclosed having a solid core portion (1) of the ferromagnetic or electrically nonconducting material, with a winding space to be wound in one or more courses and recessed relative to parallel end faces (2, 2) of the core portion. The end faces (2, 2) have dovetail-shaped cutouts (3, 3) located within the outside portion of these end faces for receiving tab-like electric contact elements (5, 5). These electrical contacts may be glued or wedged into these cutouts and retained therein under the action of resilient properties of the cutout elements.

15 Claims, 2 Drawing Figures

CHIP INDUCTOR ELECTRONIC COMPONENT

BACKGROUND OF THE INVENTION

The invention relates to electronic components, and it relates, more particularly to a chip inductor of the type having air-core coil that serves as an RF choke.

By comparison with the usual discrete wired inductors, chip inductors are physically smaller, can be manufactured at less expense, and are more suitable for use in automatic insertion machines for circuit boards. The conventional chip inductors are typically made utilizing a conventional layer technique and in part commonly formed as rectangular or cylindrical, wire-wound magnetic cores, in prticular ferrite cores.

To produce chip inductors utilizing this layer technique, a support is coated with a layer of magnetic material and on this layer a conductor track formed as a coil is applied. One conventional approach is to provide inductor sections that are combined with additional inductor sections in a stack, depending on the desired inductance. For the through-contacting of the ends of the individual coils or sectional inductors, numerous methods not explained in detail here are known and utilized by those skilled in this art.

These chip inductors are desirable due to their compact construction, capability of being soldered directly on printed circuit boards, and require no additional wires are connecting elements. A significant disadvantage, however, is their costly manufacture, due to the layering technique of manufacture. Layer thickness fluctuations of the magnetic layer, inevitable in the manufacture, cause undesirable fluctuations in the L and Q values of the inductors. As material for the coil conductor tracks, silver or a silverpalladium alloy must be used, for example, and a high ohmic resistance or the conductor tracks must be accepted. As the conductor tracks are embedded in the magnetic layer, magnetic saturation, caused by the small sized magnetic circuit occurs, even at low values. Therefore, the d-c premagnetization properties of the chip inductor are consequently reduced. Also, the number of coil turns is limited and hence the adjustable inductance is limited.

Another conventional chip inductor has a rectangular ferrite core with rectangular or cylindrical center portion as winding support and flanges formed on the support in one piece, which also has a rectangular cross-section. The contacting of the winding ends occurs by means of electrically conducting layers arranged at the flanges on the end faces, on which layers the winding ends are soldered. The finished winding is here embedded in synthetic resin and together with the flanges forms a block.

To eliminate the disadvantages of these conventional chip inductor components in terms of manufacture, partly of an electrical nature and partly of a mechanical nature, there has been proposed moreover a chip inductor equipped with a ferrite spool core. The wound spool core is embedded in a parallelepipedal seal, against the one end faces of which the ends of strip-shaped connecting elements apply, which by their other ends are contacted with electrically conducting solderable layers of the end faces of the spool core flanges (see German patent document No. 3,225,782 Al). A disadvantage of this design is that it takes two machining steps to attach the connecting elements to the coil core. First a metal plate much be glued onto the coil form, whereupon the actual connecting strip is soldered on.

In U.S. Pat. No. 3,585,553 a chip inductor is disclosed with a solid ferrite core portion of parallelepipedal form which comprises a winding space wound in one course and recessed relative to the parallel front ends of the core portion and in the region of these front ends, has cutouts for bringing out the winding ends. The recesses extend in lengthwise direction of the chip inductor, and the surfaces of the front ends on either side thereof are covered with electrically conducting layers, over which the contacting of the winding ends occurs.

While this chip inductor is of relatively simple design, the electrically conducting contact layers require a relatively complicated process in manufacturing which increases their cost.

It is an object of the present invention to provide an electronic component of the foregoing mentioned kind which can be produced at low cost and is particularly suitable for the manfacture of chip inductors.

Another object of the invention is to provide a chip inductor which meets the requirement of certain electronic equipments also with respect to high resonance frequencies insofar as it can be wound e.g. in a single course and, despite small dimensions, with a high number of turns.

A further object of the invention is to provide a chip inductor wherein the connecting elements of this electronic component are to be constituted so that they satisfy both the high mechanical requirements e.g. in assembly and also the mechanical stresses caused the possible occurrence of deflections experienced by circuit boards.

SUMMARY OF THE INVENTION

For the solution of this problem the invention broadly takes the form of an electronic component of an air core chip inductor wherein the front faces of parallel front ends of the core portion of this electronic component have marginally open cutouts parallel to each other and extending over the entire narrow or broad side of these front faces, which cutouts are suitably adapted to receive tab-like contact elements.

In accordance with the invention, suitable marginally open cutouts take the form of grooves and slits having, in particular, a dovetail cross-sectional shape.

The contact elements, which are glued or wedged into the cutouts or are retained in them by spring action protrude with their one ends over the front ends and in these components suitable for tying the windings ends they are e.g. bent in U-form or designed as plug pins.

For the retention of the contact elements by means of a clamping fit in the cutouts, it is advisable to provide a conical form for the cutouts and the contact elements with their parts insertable in the cutouts.

In terms of manufacture, the production of these electronic components and their chip inductors is simplified considerably if the contact elements are, to begin with, formed as separable parts of a system support, on these contact elements the wound core parts are applied ("plugged"), their winding ends are tied to the contact elements and optionally, if required, the chip inductor thus made is sheathed with insulating material which, for certain shielding requirements, may be mixed with carbonyl iron or ferrite. Separating the system supports fitted with these chip inductors may be done before or optionally after the sheathing with insulating material.

BRIEF DESCRIPTION OF THE DRAWING

The foregoing and other objects, features and advantages of this invention will be more fully understood and appreciated from the following description of illustrative embodiments taken in conjunction with the drawing.

In the drawing.

DETAILED DESCRIPTION

Figure 1:
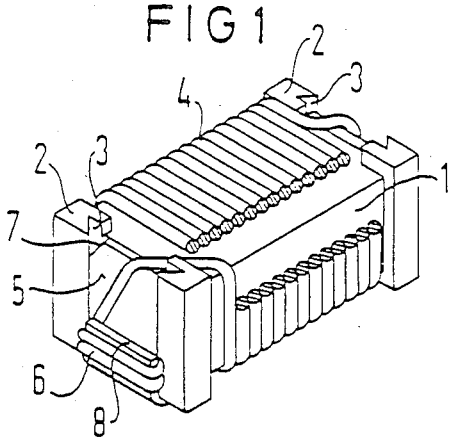
FIG. 1 illustrates a chip inductor according to the invention, partially shown in sectional form and also in perspective.

Throughout the following, like parts are designated with the same reference numerals.

In FIG. 1, a solid core portion 1 in block form which comprises, in the case of an RF choke to be produced, magnetic material, in particular ferrite. Alternatively, if an air core coil is to be produced, the solid core portion 1 would then comprise electrically nonconducting material, in particular a ceramic or plastic material. The core portion 1 is formed with a winding space which is recessed relative to its one parallel end faces 2, and which in the embodiment shown carries a single-course winding 4. The front faces of both front ends 2, 2 have marginally open cutouts 3, 3 parallel to each other and extending over the entire narrow or broad side of the front faces. Cutouts 3, 3 have a dovetail-shaped cross-section.

Into these cutouts, tab-like contact elements 5 are inserted, which for easier insertion are beveled on one of their corner edges 7. Each of the contact elements 5 has a U-shaped portion 8, protruding out from the end faces 2, 2 and intended for tying the winding ends 6.

The contact elements 5 may be glued into the cutouts 3 or may be retained in the cutouts by spring action by an appropriate selection of the size of their parts guided in the cutouts.

Figure 2:
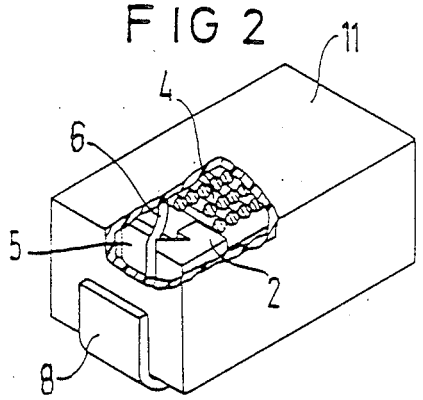
FIG. 2 shows a second illustrative embodiment of a chip inductor according to the invention, similar to that of FIG. 1 which is then covered with an insulating material.

In FIG. 2, the chip inductor is surrounded by an insulating material sheath 11, which for shielding may be mixed with carbonyl iron or ferrite. The contacting of the winding ends 6 with the contact elements 5, which can be done e.g. by welding or soldering, takes place here directly in the part of the contact elements 5 guided in the cutouts 3. The member 8 of the contact elements 5 brought out of the insulation material sheath 11 my be formed e.g. as plug pins suitable for insertion into pre-drilled circuit boards.

There has thus been shown and described a novel chip inductor which fulfills all the objects and advantages sought therefor. Many changes, modifications, variations and other uses and applications of the subject invention will, however, become apparent to those skilled in the art after considering this specification and the accompanying drawings which disclose preferred embodiment thereof. All such changes, modifications, variations and other uses and applications which do not depart from the spirit and scope of the invention are deemed to be covered by the invention which is limited only by the claims which follow.

What is claimed is:

1. An electronic component of the chip inductor type serving as either an air core coil, RF choke, or transformer, the electronic component comprising a solid integral core having perpendicular prismatic geometry including parallel end faces and having a winding space for at least one course of winding, the winding space including four contigious sides around the core and being recessed relative to the laterally extending outer portions of the parallel end faces, the winding space extending substantially from one end face to the opposite end face of the core, a winding having at least two ends and wound around the four contigious sides to substantially occupy the winding space, each end face having a cutout arranged for receiving an electrical contact element, the cutouts located in lateral external surfaces or the end faces and being marginally open cutouts and oriented parallel to one another and each cutout extending entirely over one side of each end face; and an electrical tab-like contact element mounted in each cutout and in electrical contact with an end of the winding and providing external electrical connection and mechanical mounting for the electronic component.

2. An electronic component according to claim 1, wherein the tab-like contact elements each have a portion protruding from the end faces and bent in a U-form suitable for tying the winding ends.

3. An electronic component according to claim 1, wherein the cutouts are provided in a shape including lateral grooves.

4. An electronic component according to claim 1, wherein the contact elements are glued into the cutouts.

5. An electronic component according to claim 1, wherein the cutouts each have a dovetail-shaped cross-section.

6. An electronic component according to claim 1 wherein a portion of the tab-like contact elements which is inserted in the cutouts are retained in the cutouts by a frictional fit and the cutouts have a dovetail-shaped cross-section.

7. An electronic component according to claim 2 wherein a portion of the tab-like contact elements which is inserted in the cutouts are retained in the cutouts by a frictional fit and the cutouts have a dovetail-shaped cross-section.

8. An electronic component according to claim 3, wherein a portion of the tab-like contact elements which is inserted in the cutouts are retained in the cutouts by a frictional fit and the cutouts have a dovetail-shaped cross-section.

9. An electronic component according to claim 3, wherein a portion of the contact elements is insertable into the cutouts, the cutouts and the contact elements are conical, so that the contact elements are retained in the cutouts with clamping fit.

10. An electronic component according to claim 1, wherein the tab-like contact elements also serve as separable parts for mounting the electronic component.

11. An electronic component according to claim 2, wherein the electronic component includes one or more courses of windings that are connected with the contact elements and insulating material serves as a sheath over the electronic component, in such a way that the ends of the contact elements protruding from the cutouts are at least partially external.

12. An electronic component according to claim 1, wherein the ends of the tab-like contact elements protruding from the cutouts and optionally the insulating material sheath are formed as plug pins for insertion into pre-drilled circuit boards.

13. An electronic component according to claim 11, wherein the insulating material of the sheath comprises carbonyl having magnetic material included therein for shielding purposes.

14. An electronic component according to claim 1, wherein the solid core comprises ferromagnetic material.

15. An electronic component according to claim 1, wherein the solid core comprises an electrically non-conductive material.

* * * * *